US012168840B2

(12) United States Patent
Han et al.

(10) Patent No.: US 12,168,840 B2
(45) Date of Patent: Dec. 17, 2024

(54) ELECTROCONDUCTIVE POLYMER FIBER AND ITS PREPARATION METHOD AND APPLICATION

(71) Applicants: CHINA PETROLEUM & CHEMICAL CORPORATION, Beijing (CN); BEIJING RESEARCH INSTITUTE OF CHEMICAL INDUSTRY, CHINA PETROLEUM & CHEMICAL CORPORATION, Beijing (CN)

(72) Inventors: Peng Han, Beijing (CN); Xiaohong Zhang, Beijing (CN); Jinliang Qiao, Beijing (CN); Chuanlun Cai, Beijing (CN); Jinmei Lai, Beijing (CN); Zhihai Song, Beijing (CN); Guicun Qi, Beijing (CN); Binghai Li, Beijing (CN); Xiang Wang, Beijing (CN); Jianming Gao, Beijing (CN); Hongbin Zhang, Beijing (CN); Haibin Jiang, Beijing (CN); Jiangru Zhang, Beijing (CN)

(73) Assignees: CHINA PETROLEUM & CHEMICAL CORPORATION, Beijing (CN); BEIJING RESEARCH INSTITUTE OF CHEMICAL INDUSTRY, CHINA PETROLEUM & CHEMICAL CORPORATION, Beijing (CN)

( * ) Notice: Subject to any disclaimer, the term of this patent is extended or adjusted under 35 U.S.C. 154(b) by 1220 days.

(21) Appl. No.: 15/763,013

(22) PCT Filed: Sep. 26, 2016

(86) PCT No.: PCT/CN2016/000543
§ 371 (c)(1),
(2) Date: Mar. 23, 2018

(87) PCT Pub. No.: WO2017/049814
PCT Pub. Date: Mar. 30, 2017

(65) Prior Publication Data

US 2018/0291531 A1 Oct. 11, 2018

(30) Foreign Application Priority Data

Sep. 25, 2015 (CN) ..... 201510622066.9

(51) Int. Cl.

| | |
|---|---|
| ***D01F 1/09*** | (2006.01) |
| ***D01F 6/24*** | (2006.01) |
| ***D01F 11/06*** | (2006.01) |
| ***D06M 11/09*** | (2006.01) |
| ***D06M 11/11*** | (2006.01) |
| *D06M 11/83* | (2006.01) |
| *D06M 23/10* | (2006.01) |
| *D06M 101/20* | (2006.01) |

(52) U.S. Cl.
CPC ..... *D01F 1/09* (2013.01); *D01F 6/24* (2013.01); *D01F 11/06* (2013.01); *D06M 11/09* (2013.01); *D06M 11/11* (2013.01); *D06M 11/83* (2013.01); *D06M 23/10* (2013.01); *D06M 2101/20* (2013.01); *D10B 2321/00* (2013.01); *D10B 2401/16* (2013.01)

(58) Field of Classification Search
CPC .. D01F 1/09; D01F 11/06; D01F 6/24; D06M 11/09; D06M 11/11; D06M 11/83; D06M 23/10; D06M 2101/20; D10B 2321/00; D10B 2401/16
USPC ..... 428/394, 357, 364, 373, 375, 392
See application file for complete search history.

(56) References Cited

U.S. PATENT DOCUMENTS

| | | | | |
|---|---|---|---|---|
| 2,867,552 | A * | 1/1959 | Homer | B32B 15/08 428/389 |
| 4,765,928 | A | 8/1988 | Thakur | |
| 5,177,187 | A | 1/1993 | MacDiarmid et al. | |
| 2010/0313755 | A1 | 12/2010 | Koros et al. | |

FOREIGN PATENT DOCUMENTS

| | | | |
|---|---|---|---|
| CN | 87104346 | A | 2/1988 |
| CN | 1118818 | A | 3/1996 |
| CN | 1880526 | A | 12/2006 |
| CN | 101481833 | A | 7/2009 |
| CN | 102409433 | A | 4/2012 |
| CN | 102634868 | A | 8/2012 |

(Continued)

OTHER PUBLICATIONS

Machine Translation JP 2006328610 A (Year: 2006).*
M. Thakur "A Class of Conducting Polymers Having Nonconjugated Backbones", Macromolecules, Dec. 6, 1988, p. 661-664, vol. 21, American Chemical Society, AT&T Bell Laboratories, Murray Hill, New Jersey 07974.
Mei-Xiang Luo et al. "The Influence of Fiber-Forming Conditions on Properties of Polyaniline Conducting Fiber", Guangdong Chemical Fiber, Jun. 30, 2002, p. 1-5, vol. 2, China Academic Journal Electronic Publishing House, College of Materials Science & Engineering, South China University of Technology, Guangdong Guangzhou, 51640.

(Continued)

*Primary Examiner* — Matthew D Matzek
(74) *Attorney, Agent, or Firm* — NKL Law; Allen Xue

(57) ABSTRACT

The present invention relates to an electroconductive polymer fiber having an integrated electroconductive layer on at least a part of its surface. Since the electroconductive layer of the present invention is integrally formed on the core layer of the fiber, the electroconductive polymer fiber has excellent bending resistance. The fabric comprising the electroconductive polymer fiber of the present invention retains the electrical conductivity even after repeated washing and bending. The electroconductive polymer fiber of the present invention can be used for antistatic products, electromagnetic shielding materials or stealth materials.

9 Claims, No Drawings

(56) References Cited

FOREIGN PATENT DOCUMENTS

| | | | | | |
|---|---|---|---|---|---|
| CN | 104164707 | A | | 11/2014 | |
| CN | 104278360 | A | | 1/2015 | |
| JP | 53045347 | A | * | 4/1978 | ..... C08L 21/00 |
| JP | S5742972 | A | | 3/1982 | |
| JP | S6433140 | A | | 2/1989 | |
| JP | H05287198 | A | | 11/1993 | |
| JP | 2001503449 | A | | 3/2001 | |
| JP | 2006328610 | A | * | 12/2006 | |
| JP | 2014109086 | A | | 6/2014 | |
| WO | WO-9425269 | A1 | * | 11/1994 | ..... C01G 9/02 |

OTHER PUBLICATIONS

Han, Peng et al. "Intrinsically Conductive Polymer Fibers from Thermoplastic trans-1,4 Polyisoprene" Langmuir, May 2, 2016, vol. 32, No. 19, p. 4904-4908.

Luo, Meixiang et al., "The Influence of Fibre-Forming Conditions on Properties of Polyaniline Conducting Fibre", Guangdong Chemical Fibre, Jun. 30, 2002, ISSN: 1004-2040 * (English abstract on the last page).

Shi, Chenjun., "Research on Conductive Polymer ot Polydiolefin and Polypyrrole", Science-Engineering (A), China Doctoral Dissertations Full-Text Database, Jun. 15, 2003, ISSN: 1674-022X *.

* cited by examiner

ELECTROCONDUCTIVE POLYMER FIBER AND ITS PREPARATION METHOD AND APPLICATION

TECHNICAL FIELD

The present invention relates to the field of polymer fibers, in particular to an electroconductive polymer fiber, a method for preparing an electroconductive polymer fiber, an electroconductive polymer fiber prepared by the method, a fabric comprising the electroconductive polymer fiber and the use of the electroconductive polymer fiber in the manufacture of antistatic products, electromagnetic shielding materials or stealth materials.

BACKGROUND

Compared with natural fibers, synthetic fibers are cheap and have low density and low moisture absorption, and are widely used in daily life, for example in textile and clothing, bags and the like. However, synthetic fibers have good electrical insulation and high resistivity, but are apt to produce static electricity, which are harmful for the industrial production and the people's lives. Static electricity and dusts adsorbed by static electricity are one of direct reasons for causing the malfunction, short circuit, signal loss, error code, and low yield in the modern electronic equipment. There are special requirements for the protection of static electricity in the industry of petroleum, chemical engineering, precision machinery, colliery, food, medicine and the other. Therefore, it is a very urgent issue to develop fibers having excellent electrical conductivity properties so as to reduce the harm caused by static electricity.

The electroconductive polymer material was found in the mid-1970s and has been widely followed with interest. The electroconductive polymer materials can be generally divided into intrinsically electroconductive polymer materials and filling-type electroconductive polymer materials. The intrinsically electroconductive polymer material refers to a polymer material that has electrical conductivity, and the filling-type electroconductive polymer material refers to a polymer material, in which an electrically conductive material is added so that the resulting material is electroconductive. In contrast, the intrinsically electroconductive polymer material has a permanent electrical conductivity and antistatic ability. In structure, the intrinsically electroconductive polymer material generally has conjugated double bonds in the repeating units in the molecular chains, and therefore is also referred as a conjugated polymer. Known intrinsically electroconductive polymers generally include polyaniline, polyacetylene, polythiophene, polypyrrole, polyphenylene ethylene and the like.

The intrinsically electroconductive polymer material has a wide and important application in solar cells, sensor, display and the other. However due to its characteristics of being insoluble and refractory, the intrinsically electroconductive polymer usually cannot be directly processed into fiber material. It is usually necessary to coat the intrinsically electroconductive polymer on the surface of other polymer fibers to obtain an electrical conductive fiber material, and it is impossible to obtain a whole fiber material formed from the same intrinsically electroconductive polymer. Therefore, its application is greatly limited. Furthermore, in the case of using the fibers coated with the intrinsically electroconductive polymer to make the fabric, the layer of the intrinsically electroconductive polymer may come off with the long-term use of the resulting fabric, and the bending and the scratching in use, which results in that the electrical conductive fiber loses its electrical conductivity.

In addition, as the filling-type electroconductive polymer material, a sheath-core composite fiber comprising a thermoplastic polymer containing conductive carbon black fine particles as a sheath component has also been proposed, that is, the electrical conductivity is achieved by filling carbon black fine particles in the sheath of the fiber. However, in the actual manufacturing process, the fine carbon black particles are hard to be uniformly distributed in the sheath of the fiber, adversely affecting the electrical conductivity of the fiber. In addition, when the fabric is made from such a sheath-core type composite fiber, the carbon black particles in the sheath may come off with the long-term use of the resulting fabric, and the bending and the scratching in use, which results in that the fiber loses its electrical conductivity. In addition, in the application field such as the electronics industry that has severe restrictions on static electricity, the falling carbon black fine particles scatter in the working environment and seriously affect the production of electronic products.

To sum up, due to the wide use of and the wide market for the electroconductive polymer fiber, there is an urgent need for such an electroconductive polymer fiber, which is cheap and easy to prepare and has excellent permanent electrical conductivity and antistatic ability and whose electroconductive layer hardly comes off.

SUMMARY OF INVENTION

In view of the above-described problems in the prior art, the present inventors conducted intensive studies and found that, by treating a core layer formed from a polymer having at least one double bond in its repeating units and having no conjugated double bond with a dopant, an integrated electroconductive layer can be formed on the core layer, and an electroconductive polymer fiber can be produced. The electroconductive polymer fiber has excellent permanent electrical conductivity and antistatic ability. The electroconductive layer hardly comes off. The electroconductive polymer fiber of the present invention can be easily and efficiently produced.

The present invention provides an electroconductive polymer fiber, characterized in that the fiber has an integrated electroconductive layer on at least a part of the surface thereof.

The present invention also provides a method for preparing an electroconductive polymer fiber, which comprises a step of converting at least a part of the surface of an initial fiber made from a base polymer into an electroconductive layer by treating with a dopant.

The present invention also provides a fabric comprising the electroconductive polymer fiber of the present invention or the electroconductive polymer fiber produced by the method of the present invention.

The present invention also provides use of the electroconductive polymer fiber of the present invention or the electroconductive polymer fiber made by the method of the present invention in the manufacture of antistatic products, electromagnetic shielding materials or stealth materials.

TECHNICAL EFFECT

The electroconductive polymer fiber of the present invention is a fiber having an integrated fiber electroconductive layer on at least a part of the surface of the fiber, whereby the electroconductive layer on the fiber hardly comes off, and even after repeated bending and scratching, it maintains excellent electrical conductivity and antistatic ability. In addition, according to the method for producing an electroconductive polymer fiber of the present invention, the electroconductive polymer fiber can be manufactured more efficiently, conveniently and inexpensively, and furthermore, the apparatus for manufacturing the electroconductive polymer fiber can also be miniaturized. Further, the fabric made from the electroconductive polymer fiber of the present invention has excellent electrical conductivity and antistatic property, and the electrical conductivity is maintained even after it is worn for a long time or washed repeatedly.

DETAILED DESCRIPTION

Hereinafter, the specific embodiments of the present invention will be described in detail.

It should be understood that, the specific embodiments described herein are only used for describing and explaining the present invention, and are not intended to limit the present invention.

[Electroconductive Polymer Fiber]

In the electroconductive polymer fiber of the present invention, an integrated electroconductive layer is provided on at least a part of the surface of the fiber.

Specifically, the electroconductive polymer fiber of the present invention includes a non-electroconductive core layer and an electroconductive layer integrally formed on the core layer.

In the present invention, "integrated" or "integrally formed" means that the electroconductive layer is formed in situ on the surface of the fiber, that is, a portion of the fiber itself is directly converted into an electroconductive layer, rather than the core and the electroconductive layer are separately set.

The electroconductive layer may be formed on the surface of the fiber in the form of a dot, a spot, an island, a line, a strip, or the like. It is preferable to have an integrated electroconductive layer on the entire surface of the fiber.

In the present invention, the electroconductive polymer fiber has a radial diameter d of 0.001 mm or more and 3 mm or less, preferably 0.005 mm or more and 2 mm or less, more preferably 0.01 mm or more and 1 mm or less, further more preferably 0.02 mm or more and 0.5 mm or less, particularly preferably 0.03 mm or more and 0.05 mm or less. In the present invention, the fiber diameter means, for example, when the cross section of the fiber is in form of circle, the diameter of the circle; when the cross section of the fiber is in form of rectangle, the length of the short side of the rectangle; and when the cross section of the fiber is in form of ellipse, the length of the minor axis. The fiber diameter is measured with well-known methods and devices, for example, the fiber diameter is measured with a XGD-1C type fiber diameter measurement and composition analyzer (manufactured by Shanghai New Fiber Instrument Co., Ltd.).

The thickness of the electroconductive layer integrally formed on the surface of the fiber is 0.001 d or more and less than d, preferably 0.002 d or more and 0.9 d or less, further preferably 0.01 d or more and 0.8 d or less; further more preferably 0.05 d or more and 0.7 d or less. From the viewpoint of excellent bending resistance and good electrical conductivity maintenance, the thickness of the electroconductive layer is particularly preferably 0.1 d or more and 0.5 d or less.

In the present invention, the thickness of the electroconductive layer refers to a value obtained by subtracting the diameter of the non-electroconductive core layer from the fiber diameter. The diameter of the non-electroconductive core layer can be measured with well-known methods and devices, for example, the diameter of the non-electroconductive core layer is measured with a XGD-1C type fiber diameter measurement and composition analyzer (manufactured by Shanghai New Fiber Instrument Co., Ltd.). The diameter of the non-electroconductive core layer is then subtracted from the fiber diameter to obtain a result, which is the thickness of the electroconductive layer. For example, when no electroconductive layer is formed on the surface of the fiber, the diameter of the non-electroconductive core layer is the fiber diameter, and the thickness of the electroconductive layer is zero. When the whole core layer is converted into an electrical conductive fiber, the diameter of the non-electroconductive core layer is zero, and the thickness of the electroconductive layer is the fiber diameter.

The polymer forming the non-electroconductive core layer of the present invention (hereinafter, sometimes referred to as "the polymer of the non-electroconductive core layer") is not particularly limited as long as it is a polymer that can form a conjugated polymer after treated with electron acceptor dopant and/or electron donor dopant. In one embodiment of the present invention, at least one double bond is present and no conjugated double bond is present in the repeat units of the polymer of the non-electroconductive core layer.

In one embodiment of the present invention, the repeating units of the polymer of the non-electroconductive core layer are as follows,

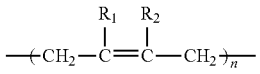

wherein, $R_1$ and $R_2$ are each independently hydrogen, halogen, $C_1$-$C_{20}$alkyl or phenyl, preferably are each independently H, Cl, Br, I, $CH_3$, $CH_2CH_3$, $CH_2CH_2CH_3$ or $C_6H_5$.

In one embodiment of the present invention, the polymer of the non-electroconductive core layer is at least one selected from the group consisting of trans-1,4-polyisoprene, cis-1,4-polyisoprene, trans-1,4-polybutadiene, cis-1,4-polybutadiene and 2,3-dimethyl-1,4-polybutadiene. From the viewpoint of excellent bending resistance and good electrical conductivity maintenance, it is preferably trans-1,4-polyisoprene.

In the present invention, the dopant is an electron acceptor and/or electron donor dopant.

Preferably, said electron acceptor dopant is at least one selected from the group consisting of $Cl_2$, $Br_2$, $I_2$, ICl, $ICl_3$, IBr, $IF_5$, $PF_5$, $AsF_5$, $SbF_5$, $BF_5$, $BCl_3$, $BBr_3$, $SO_3$, $NbF_5$, $TaF_5$, $MoF_5$, $WF_5$, $RuF_5$, $PtCl_4$, $TiCl_4$, $AgClO_4$, $AgBF_4$, $HPtCl_6$, $HIrCl_6$, tetracyanoethylene (TCNE), tetracyanoquinodimethane (TCNQ), dimethyldioxirane (DDO), HF, HCl, $HNO_3$, $H_2SO_4$, $HClO_4$, $FSO_3H$, $O_2$, $XeOF_4$, $XeF_4$, $NOSbCl_6$ and $NOPF_6$. Preferably, said electron donor dopant is at least one selected from the group consisting of Li, Na and K.

By treating the non-electroconductive core layer of the present invention with a dopant, an integrated electroconductive layer can be formed on the surface of the core layer. In one embodiment of the present invention, a non-electroconductive core layer is placed in a dopant-containing vapor or impregnated in a dopant-containing solution to form an integrated electroconductive layer. The kind of the solvent for the dopant-containing solution is not particularly limited as long as it can dissolve the dopant but not the core fiber and the finally obtained electroconductive layer. In addition, the concentration of the dopant-containing solution can be kind of routine choice in the art.

By the treatment of the non-electroconductive core layer of the present invention with a dopant, the repeating unit of the polymer of the electroconductive layer contains conjugated double bonds doped with a dopant.

Without limiting the mechanism of the present invention, the inventors speculate that the mechanism is that when the non-electroconductive core layer of the present invention is treated with a dopant, the dopant first undergoes addition reaction with the polymer and then undergoes elimination reaction to produce a polymer containing a segment of conjugated double bond, furthermore the dopant obtain electron(s) from the conjugated double bond (or loses electron(s) itself) to convert into an ionic form and correspondingly the conjugated double bond loses electron(s) (or obtains electron(s)) to convert into a doped state structure, which is different from the original structure. This structure itself has a charge and the charge can freely move on the polymer chain, thus exhibiting the electrical conductivity. Thus, an electroconductive layer, that is, an electroconductive polymer layer can be obtained. The electroconductive polymer fiber of the present invention has a volume resistivity of less than $10^9$ Ω·m, preferably less than $10^8$ Ω·m, further preferably less than $10^7$ Ω·m, still further preferably less than $10^6$ Ω·m, particularly preferably less than $10^5$ Ω·m, most preferably less than $10^4$ Ω·m.

[Preparation of Electroconductive Polymer Fibers]

The electroconductive polymer fiber of the present invention can be produced by the following steps:

A base polymer is prepared into initial fiber; and

The initial fiber is treated with a dopant so that at least a part of the surface of the initial fiber is converted into an electroconductive layer.

As the base polymer of the present invention, the above-described polymer of the non-electroconductive core layer of the present invention can be used. Likewise, the base polymer may be at least one selected from the group consisting of trans-1,4-polyisoprene, cis-1,4-polyisoprene, trans-1,4-polybutadiene, cis-1,4-polybutadiene and 2,3-dimethyl-1,4-polybutadiene. From the viewpoint of excellent bending resistance and good electrical conductivity maintenance, trans-1,4-polyisoprene is preferable.

As the dopant, the above-described dopant of the present invention is used. The treatment with a dopant is not particularly limited as long as the method of the present invention can be performed. In one embodiment of the present invention, the initial fiber is placed in a dopant-containing vapor and the initial fiber is treated. In one embodiment of the present invention, the initial fiber is impregnated in a dopant-containing solution and the initial fiber is treated.

The time for the treatment with the dopant is not particularly limited, and may be 0.5 hour or more and 70 hours or less, preferably 1 hour or more and 65 hours or less, more preferably 4 hours or more and 60 hours or less, particularly preferably 8 hours or more and 48 hours or less. By adjusting the treatment time, the thickness of the electroconductive layer can be adjusted, and therefore the electrical conductivity of the electroconductive polymer fiber can be adjusted. In general, the shorter the treatment time is, the thinner the electroconductive layer formed on the polymer core layer is, the lower the electrical conductivity is; the longer the treatment time is, the thicker the formed electroconductive layer is and the higher the electrical conductivity is. On the other hand, the ratio of the thickness of the electroconductive layer to the fiber diameter affects the bending resistance of the fiber, thereby affecting the electrical conductivity maintenance of the electroconductive polymer fiber. When the ratio is too high or too low, the bending resistance of the conductive fiber is poor. When the treatment time is too long, the core layer is not present in the electroconductive polymer fiber, that is, when the whole fiber is converted into the electroconductive polymer fiber, the bendability of the fibers is the worst.

In one embodiment of the present invention, at least a part of the surface of the initial fiber is converted to an electroconductive layer by treating with a dopant while forming the initial fiber from the base polymer. Thus, the formation of the initial fiber and the treatment with the dopant are performed simultaneously, and the production efficiency of the electroconductive polymer fiber can be greatly improved. In addition, it is also possible to miniaturize the equipment for manufacturing the electroconductive polymer fiber.

In one embodiment of the present invention, the base polymer is made into the initial fiber by melt spinning. Preferably, the melt spinning may be the screw melt extrusion spinning. The melt spinning can be done with the equipment and conditions well known in the art.

In one embodiment of the present invention, the initial fiber is longitudinally stretched prior to treating the initial fiber with a dopant. The electroconductive polymer fiber having more excellent electrical conductivity can be obtained by stretching the initial fiber longitudinally followed by the treatment with a dopant.

In one embodiment of the present invention, while the original fiber is longitudinally stretched, the freshly stretched initial fiber is treated with a dopant to convert at least a part of the surface of the initial fiber into an electroconductive layer. Thereby, the production efficiency of the electroconductive polymer fiber can be greatly improved. In addition, it is also possible to miniaturize equipment for manufacturing electroconductive polymer fiber.

In the longitudinal stretching of the initial fiber, the rate of longitudinal stretching is not particularly limited as long as the resulting fiber does not break and the desired diameter can be achieved. The rate of longitudinal stretching is 0.01 mm/min or more and 20 mm/min or less, preferably 0.05 mm/min or more and 10 mm/min or less, more preferably 0.1 mm/min or more and 5 mm/min or less, particularly preferably 0.3 mm/min or more and 1 mm/min or less.

In one embodiment of the present invention, the longitudinally stretched initial fiber has a diameter of 0.001 mm or more and 3 mm or less, preferably 0.005 mm or more and 2 mm or less, more preferably 0.01 mm or more and 1 mm or less, further more preferably 0.02 mm or more and 0.5 mm or less, particularly preferably 0.03 mm or more and 0.05 mm or less.

The temperature for longitudinal stretching is not particularly limited as long as it is below the melting point of the initial fiber, and it is preferable to conduct the longitudinal stretching at room temperature (20-40° C.).

It is preferable that the stretching is held at the stretching temperature for a certain period of time after the longitudinal stretching so that the polymer can be sufficiently oriented, wherein the holding time is not particularly limited and may be an arbitrary time. From the viewpoint of saving the manufacturing process and improving the work efficiency, the holding time is preferably 30 minutes or less, and more preferably 20 minutes or less.

In production of the initial fiber, various conventional auxiliaries such as antioxidants, plasticizers, lubricants, pigments and other processing aids may be added to the base polymer to the extent that the effects of the present invention are not impaired. The amount of these auxiliaries can be any conventional amount in the art, and can be adjusted according to the actual requirement.

[Fabric]

The fabric of the present invention is made from the electroconductive polymer fiber of the present invention.

In addition to the electroconductive polymer fiber of the present invention, the fabric of the present invention may include conventional fibers such as polyester fibers, polyurethane fibers, polyether ester fibers, and the like. From the viewpoint of producing a fabric having excellent conductivity, the content of the electroconductive polymer fiber in the fabric is 0.1 wt % or more, preferably 1 wt % or more, and more preferably 3 wt % or more. In addition, from the viewpoint of hand-feel and wearing comfort of the fabric, the content of electroconductive polymer fiber in the fabric is 80 wt % or less, preferably 70 wt % or less, more preferably 50 wt % or more, more preferably 40 wt % or less, still more preferably 30 wt % or less.

In addition, the electroconductive polymer fiber of the present invention is useful in the manufacture of antistatic products, electromagnetic shielding materials or stealth materials.

EXAMPLE

The present invention will be further illustrated by the following examples, but the present invention is not limited to these examples in any way.

[Fiber Diameter]

The fiber diameter is measured with a XGD-1C type fiber diameter measurement and composition analyzer (manufactured by Shanghai New Fiber Instrument Co., Ltd.).

[Thickness of the Electroconductive Layer]

The diameter of the non-electroconductive core layer of the fiber is measured using a XGD-1C type fiber diameter measurement and composition analyzer (manufactured by Shanghai New Fiber Instrument Co., Ltd.). The thickness of the electroconductive layer is expressed as Thickness of electroconductive layer=diameter of fiber−diameter of non-electroconductive core layer

[Volume Resistance and Volume Resistivity of Fiber]

The volume resistance $R_v$ of the electroconductive polymer fiber is measured using a Keithley 6517B high resistance meter (manufactured by Keithley).

The volume resistivity $\rho_v$ of the fiber is calculated according to the following formula:

$$\rho_v = R_v \cdot \frac{\pi \cdot d^2}{4t}.$$

wherein d represents the fiber diameter, t represents the length of the fiber between the two measuring electrodes.

[Bending Resistance]

A sample of the electroconductive polymer fiber having a length of 4 cm is measured for its volume resistivity, denoted as $R_i$. The sample of the electroconductive polymer fiber is fixed at its middle point; two arms are tightly pulled and bent toward the same direction until the angle between two arms is less than 60 degrees, and then two arms are bent toward the opposite direction until the angle between two arms is less than 60 degrees, which is a cycle of operation. After 100 cycles of operation, the test is completed. The volume resistivity of the electroconductive polymer fiber after the completion of the test is measured and recorded as Ry. Variation of volume resistivity is calculated by the following formula.

$$\text{Variation of volume resistivity}=(R_y-R_i)/R_i\times 100\%$$

The smaller the variation of volume resistivity is, the more excellent the bending resistance of the fiber is.

Example 1

This example is used to illustrate the electroconductive polymer fiber provided by the present invention and the preparation method thereof.

Trans-1,4-polyisoprene (Mooney viscosity=84) was extruded in an extruder (Haake MiniLab), wherein the processing temperature was 120° C., the outlet diameter of the extruder's die was 0.5 mm, and the fiber diameter obtained by extrusion was 0.7 mm. At the room temperature of 25° C., the resulting polymer fiber was stretched with an INSTRON 3366-type stretcher to produce fibers having a diameter of 0.3 mm. After the complete of stretching, the stretching force was held for 30 mins so that the polymer was sufficiently oriented. The stretched polymer fiber was placed in an iodine vapor atmosphere to react for 48 hours to produce an electroconductive polymer fiber, comprising a non-electroconductive polymeric core layer and an electroconductive layer formed on the core layer, wherein the thickness of the electroconductive layer was 0.15 mm. The test results for the volume resistivity and the variation of volume resistivity of the electroconductive polymer fiber are shown in Table 1.

Example 2

This example is used to illustrate the electroconductive polymer fiber provided by the present invention and the preparation method thereof.

The electroconductive polymer fiber was prepared according to the method of Example 1, except that the polymer fiber having a diameter of 0.7 mm obtained by extrusion in Example 1 was directly placed without stretching in an iodine vapor atmosphere to react for 48 hours to produce an electroconductive polymer fiber, comprising a non-electroconductive polymeric core layer and an electroconductive layer formed on the core layer, wherein the thickness of the electroconductive layer was 0.35 mm. The test results for the volume resistivity and the variation of volume resistivity of the electroconductive polymer fiber are shown in Table 1.

Example 3

This example is used to illustrate the electroconductive polymer fiber provided by the present invention and the preparation method thereof.

Trans-1,4-polyisoprene (Mooney viscosity=84) was extruded in an extruder (Haake MiniLab), wherein the processing temperature was 120° C., the outlet diameter of the extruder's die was 1.0 mm, and the fiber diameter obtained by extrusion was 1.2 mm. At the room temperature of 25° C., the resulting polymer fiber was stretched with an INSTRON 3366-type stretcher to produce fibers having a diameter of 0.7 mm. After the complete of stretching, the stretching force was held for 30 mins so that the polymer was sufficiently oriented. The stretched polymer fiber was placed in an iodine vapor atmosphere to react for 48 hours to produce an electroconductive polymer fiber, comprising a non-electroconductive polymeric core layer and an electroconductive layer formed on the core layer, wherein the thickness of the electroconductive layer was 0.35 mm. The test results for the volume resistivity and the variation of volume resistivity of the electroconductive polymer fiber are shown in Table 1.

Example 4

This example is used to illustrate the electroconductive polymer fiber provided by the present invention and the preparation method thereof.

The electroconductive polymer fiber was prepared according to the method of Example 3, except that the polymer fiber having a diameter of 1.2 mm obtained by extrusion in Example 3 was directly placed without stretching in an iodine vapor atmosphere to react for 48 hours to produce an electroconductive polymer fiber, comprising a non-electroconductive polymeric core layer and an electroconductive layer formed on the core layer, wherein the thickness of the electroconductive layer was 0.6 mm. The test results for the volume resistivity and the variation of volume resistivity of the electroconductive polymer fiber are shown in Table 1.

Example 5

This example is used to illustrate the electroconductive polymer fiber provided by the present invention and the preparation method thereof.

Trans-1,4-polyisoprene (Mooney viscosity=84) was extruded in an extruder (Haake MiniLab), wherein the processing temperature was 120° C., the outlet diameter of the extruder's die was 1.5 mm, and the fiber diameter obtained by extrusion was 1.7 mm. At the room temperature of 25° C., the resulting polymer fiber was stretched with an INSTRON 3366-type stretcher to produce fibers having a diameter of 1.2 mm. After the complete of stretching, the stretching force was held for 30 mins so that the polymer was sufficiently oriented. The stretched polymer fiber was placed in an iodine vapor atmosphere to react for 48 hours to produce an electroconductive polymer fiber, comprising a non-electroconductive polymeric core layer and an electroconductive layer formed on the core layer, wherein the thickness of the electroconductive layer was 0.6 mm. The test results for the volume resistivity and the variation of volume resistivity of the electroconductive polymer fiber are shown in Table 1.

Example 6

This example is used to illustrate the electroconductive polymer fiber provided by the present invention and the preparation method thereof.

The electroconductive polymer fiber was prepared according to the method of Example 5, except that the polymer fiber having a diameter of 1.7 mm obtained by extrusion in Example 5 was directly placed without stretching in an iodine vapor atmosphere to react for 48 hours to produce an electroconductive polymer fiber, comprising a non-electroconductive polymeric core layer and an electroconductive layer formed on the core layer, wherein the thickness of the electroconductive layer was 0.85 mm. The test results for the volume resistivity and the variation of volume resistivity of the electroconductive polymer fiber are shown in Table 1.

Example 7

This example is used to illustrate the electroconductive polymer fiber provided by the present invention and the preparation method thereof.

Trans-1,4-polyisoprene (Mooney viscosity=84) was extruded in an extruder (Haake MiniLab), wherein the processing temperature was 120° C., the outlet diameter of the extruder's die was 2.0 mm, and the fiber diameter obtained by extrusion was 2.2 mm. At the room temperature of 25° C., the resulting polymer fiber was stretched with an INSTRON 3366-type stretcher to produce fibers having a diameter of 1.7 mm. After the complete of stretching, the stretching force was held for 30 mins so that the polymer was sufficiently oriented. The stretched polymer fiber was placed in an iodine vapor atmosphere to react for 48 hours to produce an electroconductive polymer fiber, comprising a non-electroconductive polymeric core layer and an electroconductive layer formed on the core layer, wherein the thickness of the electroconductive layer was 0.85 mm. The test results for the volume resistivity and the variation of volume resistivity of the electroconductive polymer fiber are shown in Table 1.

Example 8

This example is used to illustrate the electroconductive polymer fiber provided by the present invention and the preparation method thereof.

The electroconductive polymer fiber was prepared according to the method of Example 7, except that the polymer fiber having a diameter of 2.2 mm obtained by extrusion in Example 7 was directly placed without stretching in an iodine vapor atmosphere to react for 48 hours to produce an electroconductive polymer fiber, comprising a non-electroconductive polymeric core layer and an electroconductive layer formed on the core layer, wherein the thickness of the electroconductive layer was 1.1 mm. The test results for the volume resistivity and the variation of volume resistivity of the electroconductive polymer fiber are shown in Table 1.

Example 9

This example is used to illustrate the electroconductive polymer fiber provided by the present invention and the preparation method thereof.

Trans-1,4-polyisoprene (Mooney viscosity=84) was extruded in an extruder (Haake MiniLab), wherein the processing temperature was 120° C., the outlet diameter of the extruder's die was 3.0 mm, and the fiber diameter obtained by extrusion was 3.2 mm. At the room temperature of 25° C., the resulting polymer fiber was stretched with an INSTRON 3366-type stretcher to produce fibers having a diameter of 2.2 mm. After the complete of stretching, the stretching force was held for 30 mins so that the polymer was sufficiently oriented. The stretched polymer fiber was placed in an iodine vapor atmosphere to react for 48 hours to produce an electroconductive polymer fiber, comprising a non-electroconductive polymeric core layer and an electroconductive layer formed on the core layer, wherein the thickness of the electroconductive layer was 1.1 mm. The test results for the volume resistivity and the variation of volume resistivity of the electroconductive polymer fiber are shown in Table 1.

Example 10

This example is used to illustrate the electroconductive polymer fiber provided by the present invention and the preparation method thereof.

The electroconductive polymer fiber was prepared according to the method of Example 9, except that the polymer fiber having a diameter of 3.2 mm obtained by extrusion in Example 9 was directly placed without stretching in an iodine vapor atmosphere to react for 48 hours to produce an electroconductive polymer fiber, comprising a non-electroconductive polymeric core layer and an electroconductive layer formed on the core layer, wherein the thickness of the electroconductive layer was 1.6 mm. The test results for the volume resistivity and the variation of volume resistivity of the electroconductive polymer fiber are shown in Table 1.

Example 11

This example is used to illustrate the electroconductive polymer fiber provided by the present invention and the preparation method thereof.

This example was the same as in Example 1, except that the reaction time for placing the stretched polymer fiber in an iodine vapor atmosphere was changed to 1 hour to produce an electroconductive polymer fiber, comprising a non-electroconductive polymeric core layer and an electroconductive layer formed on the core layer, wherein the thickness of the electroconductive layer was 0.003 mm. The test results for the volume resistivity and the variation of volume resistivity of the electroconductive polymer fiber are shown in Table 1.

Example 12

This example is used to illustrate the electroconductive polymer fiber provided by the present invention and the preparation method thereof.

This example was the same as in Example 1, except that the reaction time for placing the stretched polymer fiber in an iodine vapor atmosphere was changed to 2 hours to produce an electroconductive polymer fiber, comprising a non-electroconductive polymeric core layer and an electroconductive layer formed on the core layer, wherein the thickness of the electroconductive layer was 0.006 mm. The test results for the volume resistivity and the variation of volume resistivity of the electroconductive polymer fiber are shown in Table 1.

Example 13

This example is used to illustrate the electroconductive polymer fiber provided by the present invention and the preparation method thereof.

This example was the same as in Example 1, except that the reaction time for placing the stretched polymer fiber in an iodine vapor atmosphere was changed to 4 hours to produce an electroconductive polymer fiber, comprising a non-electroconductive polymeric core layer and an electroconductive layer formed on the core layer, wherein the thickness of the electroconductive layer was 0.012 mm. The test results for the volume resistivity and the variation of volume resistivity of the electroconductive polymer fiber are shown in Table 1.

Example 14

This example is used to illustrate the electroconductive polymer fiber provided by the present invention and the preparation method thereof.

This example was the same as in Example 1, except that the reaction time for placing the stretched polymer fiber in an iodine vapor atmosphere was changed to 6 hours to produce an electroconductive polymer fiber, comprising a non-electroconductive polymeric core layer and an electroconductive layer formed on the core layer, wherein the thickness of the electroconductive layer was 0.02 mm. The test results for the volume resistivity and the variation of volume resistivity of the electroconductive polymer fiber are shown in Table 1.

Example 15

This example is used to illustrate the electroconductive polymer fiber provided by the present invention and the preparation method thereof.

This example was the same as in Example 1, except that the reaction time for placing the stretched polymer fiber in an iodine vapor atmosphere was changed to 8 hours to produce an electroconductive polymer fiber, comprising a non-electroconductive polymeric core layer and an electroconductive layer formed on the core layer, wherein the thickness of the electroconductive layer was 0.025 mm. The test results for the volume resistivity and the variation of volume resistivity of the electroconductive polymer fiber are shown in Table 1.

Example 16

This example is used to illustrate the electroconductive polymer fiber provided by the present invention and the preparation method thereof.

This example was the same as in Example 1, except that the reaction time for placing the stretched polymer fiber in an iodine vapor atmosphere was changed to 24 hours to produce an electroconductive polymer fiber, comprising a non-electroconductive polymeric core layer and an electroconductive layer formed on the core layer, wherein the thickness of the electroconductive layer was 0.075 mm. The test results for the volume resistivity and the variation of volume resistivity of the electroconductive polymer fiber are shown in Table 1.

Example 17

This example is used to illustrate the electroconductive polymer fiber provided by the present invention and the preparation method thereof.

This example was the same as in Example 1, except that the reaction time for placing the stretched polymer fiber in an iodine vapor atmosphere was changed to 54 hours to produce an electroconductive polymer fiber, comprising a non-electroconductive polymeric core layer and an electroconductive layer formed on the core layer, wherein the thickness of the electroconductive layer was 0.18 mm. The test results for the volume resistivity and the variation of volume resistivity of the electroconductive polymer fiber are shown in Table 1.

Example 18

This example is used to illustrate the electroconductive polymer fiber provided by the present invention and the preparation method thereof.

This example was the same as in Example 1, except that the reaction time for placing the stretched polymer fiber in an iodine vapor atmosphere was changed to 60 hours to produce an electroconductive polymer fiber, comprising a non-electroconductive polymeric core layer and an electroconductive layer formed on the core layer, wherein the thickness of the electroconductive layer was 0.21 mm. The test results for the volume resistivity and the variation of volume resistivity of the electroconductive polymer fiber are shown in Table 1.

Example 19

This example is used to illustrate the electroconductive polymer fiber provided by the present invention and the preparation method thereof.

This example was the same as in Example 1, except that the reaction time for placing the stretched polymer fiber in an iodine vapor atmosphere was changed to 64 hours to produce an electroconductive polymer fiber, comprising a non-electroconductive polymeric core layer and an electroconductive layer formed on the core layer, wherein the thickness of the electroconductive layer was 0.24 mm. The test results for the volume resistivity and the variation of volume resistivity of the electroconductive polymer fiber are shown in Table 1.

Example 20

This example is used to illustrate the electroconductive polymer fiber provided by the present invention and the preparation method thereof.

Trans-1,4-polyisoprene (Mooney viscosity=54.2) was extruded in an extruder (Haake MiniLab), wherein the processing temperature was 140° C., the outlet diameter of the extruder's die was 0.5 mm, and winded with a cylinder having a diameter of 2 cm at a speed of 600 rpm to produce a polymer fiber having a diameter of 0.1 mm.

The polymer fiber having a diameter of 0.1 mm was stretched with an INSTRON 3366-type stretcher to a diameter of 0.05 mm. After the complete of stretching, the stretching force was held for 30 mins so that the polymer was sufficiently oriented. At the room temperature of 25° C., the resulting polymer fiber having a diameter of 0.05 mm was placed in an iodine vapor atmosphere to react for 48 hours to produce an electroconductive polymer fiber, comprising a non-electroconductive polymeric core layer and an electroconductive layer formed on the core layer, wherein the thickness of the electroconductive layer was 0.025 mm. The volume resistivity of the electroconductive polymer fiber is measured to be 1 δ·m.

Example 21

This example is used to illustrate the electroconductive polymer fiber provided by the present invention and the preparation method thereof.

Trans-1,4-polyisoprene (Mooney viscosity=44.8) was extruded in an extruder (Haake MiniLab), wherein the processing temperature was 135° C., the outlet diameter of the extruder's die was 0.5 mm, and winded with a cylinder having a diameter of 2 cm at a speed of 600 rpm to produce a polymer fiber having a diameter of 0.1 mm.

The polymer fiber having a diameter of 0.1 mm was stretched with an INSTRON 3366-type stretcher to a diameter of 0.05 mm. After the complete of stretching, the stretching force was held for 30 mins so that the polymer was sufficiently oriented. At the room temperature of 25° C., the resulting polymer fiber having a diameter of 0.05 mm was placed in an iodine vapor atmosphere to react for 48 hours to produce an electroconductive polymer fiber, comprising a non-electroconductive polymeric core layer and an electroconductive layer formed on the core layer, wherein the thickness of the electroconductive layer was 0.025 mm. The volume resistivity of the electroconductive polymer fiber is measured to be 1 Ω·m.

Example 22

This example is used to illustrate the electroconductive polymer fiber provided by the present invention and the preparation method thereof.

The polymer fiber having a diameter of 0.7 mm obtained by extrusion and stretching in Example 2 was placed in a solution of iodine in ethanol (0.2 mol/L) to react for 48 hours, then taken out and dried to produce an electroconductive polymer fiber, comprising a non-electroconductive polymeric core layer and an electroconductive layer formed on the core layer, wherein the thickness of the electroconductive layer was 0.35 mm. The test results for the volume resistivity and the variation of volume resistivity of the electroconductive polymer fiber are shown in Table 1.

Example 23

This example is used to illustrate the electroconductive polymer fiber provided by the present invention and the preparation method thereof.

The electroconductive polymer fiber was prepared according to the method of Example 1, except for replacing trans-1,4-polyisoprene with cis-1,4-polybutadiene and replacing the iodine vapor with a sodium vapor to produce an electroconductive polymer fiber, comprising a non-electroconductive polymeric core layer and an electroconductive layer formed on the core layer, wherein the thickness of the electroconductive layer was 0.15 mm. The test results for the volume resistivity and the variation of volume resistivity of the electroconductive polymer fiber are shown in Table 1.

Comparative Example 1

This comparative example is used to illustrate the reference polymer fibers and the preparation method thereof.

This comparative example was the same as in Example 1, except that the reaction time for placing the stretched polymer fiber in an iodine vapor atmosphere was changed to 0 h to obtain a polymer fiber comprising only a non-electroconductive polymer core layer. The test results for the volume resistivity and the variation of volume resistivity of the electroconductive polymer fiber are shown in Table 1.

Comparative Example 2

This example is used to illustrate the electroconductive polymer fiber provided by the present invention and the preparation method thereof.

This comparative example was the same as in Example 1, except that the reaction time for placing the stretched polymer fiber in an iodine vapor atmosphere was changed to 72 hours to obtain an electroconductive polymer fiber in which the entire electroconductive polymer fiber is formed from an electroconductive polymer, i.e., the thickness of the electroconductive layer was 0.3 mm. The test results for the volume resistivity and the variation of volume resistivity of the electroconductive polymer fiber are shown in Table 1.

TABLE 1

Diameter and the corresponding volume resistivity of electroconductive polymer fiber

| Example | Diameter of electroconductive polymer fiber (mm) | Electroconductive layer thickness (mm) | Volume resistivity of electroconductive polymer fiber (Ω · m) | Electroconductive layer thickness/Diameter of electroconductive polymer fiber | Variation of volume resistivity |
|---|---|---|---|---|---|
| Example 1 | 0.3 | 0.15 | $3.0 \times 10^2$ | 0.5 | 10% |
| Example 2 | 0.7 | 0.35 | $3.0 \times 10^4$ | 0.5 | 10% |
| Example 3 | 0.7 | 0.35 | $6.0 \times 10^2$ | 0.5 | 10% |
| Example 4 | 1.2 | 0.6 | $1.0 \times 10^5$ | 0.5 | 10% |
| Example 5 | 1.2 | 0.6 | $1.0 \times 10^3$ | 0.5 | 10% |
| Example 6 | 1.7 | 0.85 | $3.0 \times 10^5$ | 0.5 | 10% |
| Example 7 | 1.7 | 0.85 | $2.0 \times 10^3$ | 0.5 | 10% |
| Example 8 | 2.2 | 1.1 | $6.0 \times 10^5$ | 0.5 | 10% |
| Example 9 | 2.2 | 1.1 | $5.0 \times 10^3$ | 0.5 | 10% |
| Example 10 | 3.2 | 1.6 | $8.0 \times 10^5$ | 0.5 | 10% |
| Example 11 | 0.3 | 0.003 | $6.0 \times 10^7$ | 0.01 | 30% |
| Example 12 | 0.3 | 0.006 | $1.2 \times 10^6$ | 0.02 | 28% |
| Example 13 | 0.3 | 0.012 | $1.2 \times 10^5$ | 0.04 | 24% |
| Example 14 | 0.3 | 0.02 | $6.0 \times 10^4$ | 0.066 | 20% |
| Example 15 | 0.3 | 0.025 | $1.2 \times 10^4$ | 0.083 | 18% |
| Example 16 | 0.3 | 0.075 | $8.0 \times 10^3$ | 0.25 | 15% |
| Example 17 | 0.3 | 0.18 | $7.0 \times 10^3$ | 0.6 | 15% |
| Example 18 | 0.3 | 0.21 | $6.0 \times 10^3$ | 0.7 | 18% |
| Example 19 | 0.3 | 0.24 | $5.0 \times 10^3$ | 0.8 | 20% |
| Example 20 | 0.05 | 0.025 | 1 | 0.5 | 10% |
| Example 21 | 0.05 | 0.025 | 1 | 0.5 | 10% |
| Example 22 | 0.7 | 0.35 | $2.0 \times 10^4$ | 0.5 | 10% |
| Example 23 | 0.3 | 0.15 | $3.0 \times 10^5$ | 0.5 | 24% |
| Comparative Example 1 | 0.3 | — | — | — | — |
| Comparative Example 2 | 0.3 | 0.3 | $3.1 \times 10^3$ | 1 | Fibers broken, not measurable |

From the above results, it can be seen that the electroconductive polymer fibers obtained by the method of the present invention have a low volume resistivity, indicating that the electroconductive polymer fibers of the present invention exhibit excellent conductivity and antistatic properties. In addition, when the initial fibers are longitudinally stretched prior to the doping treatment, the initial fibers can be oriented to obtain electroconductive polymer fibers having a lower volume resistivity.

In the present invention, the resulting electroconductive polymer fiber has excellent bending resistance by adjusting the thickness of the electroconductive layer. That is to say, the volume resistivity of the electroconductive polymer fiber of the present invention has a small change in the bending resistance test. On the contrary, as shown in the comparative example, when the entire fiber was converted into the electroconductive polymer fiber, although the electrical conductivity of the fiber was improved, the bending resistance of the fiber was poor, and in the bending resistance test, the electroconductive polymer fiber broke.

The preferred embodiments of the present invention are described in detail hereinabove. However, the present invention is not limited to the specific details of the above embodiments. Various simple modifications may be made to the technical solutions of the present invention within the scope of the technical concept of the present invention. All belong to the protection scope of the present invention.

In addition, it should be noted that each specific technical feature described in the foregoing specific embodiments may be combined in any suitable manner without contradiction. In order to avoid unnecessary repetition, the present invention does not describe the various possible combinations.

In addition, any combination of various embodiments of the present invention may also be adopted as long as it does not violate the spirit of the present invention, and it should be also regarded as the disclosure of the present invention.

INDUSTRIAL UTILITY

The electroconductive polymer fiber of the present invention is obtained by integrally forming an electroconductive layer on a core layer of a fiber. The electroconductive polymer fiber of the present invention has excellent electrical conductivity and exhibits excellent bending resistance. The fabric made from the electroconductive polymer fiber of the present invention retains the electrical conductivity even after repeated washing and bending.

The invention claimed is:

1. An electroconductive polymer fiber consisting of a non-electroconductive core layer and an electroconductive layer integrally formed on at least a portion of the surface of the non-electroconductive core layer, wherein, based on the diameter (d) of the electroconductive polymer fiber, a thickness of the electroconductive layer is 0.25 d or more and 0.6 d or less, and the diameter (d) of the electroconductive polymer fiber is 0.3 mm or more and 3 mm or less, the non-electroconductive core layer is made of a polymer, and the electroconductive layer comprises the polymer and a dopant that is an electron acceptor dopant, an electron donor dopant, or both, wherein the electron acceptor dopant is at least one selected from the group consisting of $Cl_2$, $Br_2$, $I_2$, ICl, $ICl_3$, IBr, $IF_5$, $PF_5$, $AsF_5$, $SbF_5$, $BF_5$, $BCl_3$, $BBr_3$, $SO_3$, $NbF_5$, $TaF_5$, $MoF_5$, $WF_5$, $RuF_5$, $PtCl_4$, $TiCl_4$, $AgClO_4$, $AgBF_4$, $HPtCl_6$, $HIrCl_6$, tetracyanoethylene (TCNE), tetracyanoquinodimethane (TCNQ), dimethyldioxirane (DDO), HF, HCl, $HNO_3$, $H_2SO_4$, $HClO_4$, $FSO_3H$, $O_2$, $XeOF_4$, $XeF_4$, $NOSbCl_6$, and $NOPF_6$, and the electron donor dopant is at least one selected from the group consisting of Li, Na, and K, wherein a repeating unit of the polymer contains at least one double bond and does not contain conjugated double bonds.

2. The electroconductive polymer fiber according to claim 1, wherein based on the diameter (d) of the electroconductive polymer fiber, the thickness of the electroconductive layer is 0.25 d or more and 0.5 d or less and the diameter (d) of the electroconductive polymer fiber is 0.03 mm or more and 1 mm or less.

3. The electroconductive polymer fiber according to claim 1, wherein a repeating unit of the polymer is

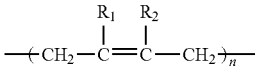

wherein $R_1$ and $R_2$ are each independently hydrogen, halogen, $C_1$-$C_{20}$ alkyl, or phenyl.

4. The electroconductive polymer fiber according to claim 1, wherein the polymer is at least one selected from the group consisting of trans-1,4-polyisoprene, cis-1,4-polyisoprene, trans-1,4-polybutadiene, cis-1,4-polybutadiene, and 2,3-dimethyl-1,4-polybutadiene.

5. The electroconductive polymer fiber according to claim 1, wherein the electroconductive layer is obtained by placing the non-electroconductive core layer in a vapor containing the dopant, or by impregnating the non-electroconductive core layer in a solution containing the dopant.

6. A fabric comprising the electroconductive polymer fiber according to claim 1.

7. The electroconductive polymer fiber according to claim 1, having the electroconductive layer disposing on an entire surface of the electroconductive polymer fiber.

8. The electroconductive polymer fiber according to claim 2, wherein the thickness of the electroconductive layer ranges from 0.1 d to 0.5 d, and the diameter (d) of the electroconductive polymer fiber is from 0.03 mm to 0.05 mm.

9. The electroconductive polymer fiber according to claim 1, wherein $R_1$ and $R_2$ are each independently H, Cl, Br, I, $CH_3$, $CH_2CH_3$, $CH_2CH_2CH_3$, or $C_6H_5$.

* * * * *